United States Patent [19]

Bernath

[11] 3,942,408

[45] Mar. 9, 1976

[54] METHOD OF TREATING AND PRODUCING IMPROVED AMMUNITION

[75] Inventor: John Bernath, Los Angeles, Calif.

[73] Assignee: Du-Kote Corporation, San Jacinto, Calif.

[22] Filed: Sept. 21, 1972

[21] Appl. No.: 290,960

[52] U.S. Cl. ..... 86/19; 427/435

[51] Int. Cl.[2] ..... F42B 31/02

[58] Field of Search ..... 86/19; 117/135

[56] References Cited

UNITED STATES PATENTS

| | | | |
|---|---|---|---|
| 158,960 | 1/1875 | Meigs | 86/19 |
| 1,678,162 | 7/1928 | Pederson | 117/135 |
| 1,780,566 | 11/1930 | Pederson | 86/19 UX |
| 1,953,904 | 4/1934 | Bowry et al. | 86/19 X |

FOREIGN PATENTS OR APPLICATIONS

| | | | |
|---|---|---|---|
| 304,948 | 3/1928 | United Kingdom | 86/19 |

*Primary Examiner*—Leland A. Sebastian
*Attorney, Agent, or Firm*—Georges A. Maxwell

[57] ABSTRACT

The method of hermetically sealing the ammunition between the bullet and casing of an ammunition round and establishing a jacket with a soft, lubricous, plastic inner layer of hydrogenated vegetable oil and a thin hard, dry frangible outer layer of carnuba wax on and about the bullet forward of the casing and about the forward portion of the casing, said method comprising dipping the bullet and forward end of the casing in a heated molten mixture of oil and wax and permitting the round to heat sufficiently to expand and drive air and moisture out of the casing between the bullet and casing, extracting the round from the solution and first chilling the surface of the solution on the round to cause the wax at and adjacent to said surface to coelesce, set and harden, whereby the outer layer of the jacket is established to contain the inner layer and to thereafter permit the round to cool and the oil and wax beneath the outer layer to solidify.

11 Claims, 8 Drawing Figures

METHOD OF TREATING AND PRODUCING IMPROVED AMMUNITION

This invention has to do with a novel process for treating and protecting ammunition more specifically. The invention relates to a novel method of establishing dry, hermetically sealed and coated rounds of ammunition such as is provided for use in firearms, such as rifles and pistols and which includes elongate metallic shells or casings in which powder is contained, metallic bullets engaged in and projecting from one end of the casings and primers or detonators engaged in and carried by the other end of the casings.

In the art of ammunition of the character referred to above, large quantities of ammunition rounds are produced and are stored for protracted periods of time. Such ammunition is stored for the military throughout the world in all different climatic zones and is often subjected to extremely adverse environmental conditions.

The casings of such ammunition are made of brass and the bullets are made of lead and are frequently provided with a protective brass jacket.

In the manufacture of such ammunition, that is, during loading of ammunition, when the primer or detonator means are related to the casings; when the powder is deposited in the casings and when the bullets are, finally, engaged in the casings, every effort is made to keep the primer and the powder as dry and free of moisture as is possible, to establish as near as is possible, a hermetic seal between the casing and the bullet, so that when the ammunition is stored in humid environments, the primer and powder will not pick up or collect moisture and be rendered defective and so that the interior of the casing and the portion of the bullet therein will not oxidize and become fouled.

In one form of ammunition, the rear end of the casing is closed and the detonator is engaged therein from the other or open front end thereof. Such ammunition is ordinarily that form or class of ammunition referred to as rim fire ammunition and is such that no sealing problem exists at the rear end of the casing.

In another and most common form of ammunition, referred to as center fire ammunition, the rear end of the casing is provided with a central rearwardly opening primer receiving socket and a fire opening or port establishing communication between the bottom of the socket and the interior of the casing. The primer in such ammunition consists of a forwardly opening metallic cup press fitted in the socket and carrying a phosphor material which is ignited and burns when subjected to an appropriate impact, as by means of a firing pin.

In such ammunition, the primer can be and is normally effectively hermetically sealed by a soft pastelike sealing compound which is deposited between the cup and the side wall of the socket, as by a simple wiping operation.

In light of the above, it will be apparent that in the art, as now practiced, no real sealing problem exists with respect to the rear ends of the casings.

As regards the front ends of such casings, that is, the ends thereof with which the bullets are related, a practical, effective and dependable sealing means has yet to be provided. Those sealing means which have been provided and which are effective and dependable have proven to be so costly to establish as to be impractical.

The standard or conventional relationship between casings and bullets in most ammunition consists of a crimped or radially inwardly formed cylindrical, front edge portion on casings, in snug holding engagement on and about cylindrical rear end portions of the bullets arranged within the open front end portion of the casing. The crimped portion of the casings must establish sufficiently tight engagement with the bullets to prevent their accidental or free displacement therefrom. But must not be so tight as will result in deformation and scarring of the bullets and/or prevent their free separation from the casings when the ammunition is fired in related firearms or rifles.

As a result of the above requirements, a sufficiently close and right engagement between a bullet and a casing to effect a dependable hermetic seal therebetween is not ordinarily attainable.

In many cases, bullets are provided with radially outwardly openings annular, orienting and retaining grooves in their rear portions and in which the forward, crimped, front end portions of related casings are engaged. Such grooves are most frequently characterized by serrated surfaces which can be deformed by the crimped portions of the casing so that a matted engagement which is less apt to permit relative working between the bullets and casings is established. While the above end is effectively attained by such structures, the establishment of an effective seal between the casings and bullets is practically eliminated.

In efforts to seal between the bullets and casings of ammunition, the prior art has sought to apply a coating of sealing material on and about the forward portion of the ammunition, which material overlies the space between the casing and the bullet at the front end of the casing. Such coatings are applied cold as by submerging the ammunition in a liquid body of the sealing material, or by spraying the ammunition with such material. Dipping or submerging of the ammunition is considered less desirable than spraying, as the material is extremely thin or light and tends to flow into the casing and contaminate the powder.

In any event, when coating such ammunition in the above or similar manners, any and all of the moisture in the casings, at the time of coating the ammunition, is trapped therein.

The materials used by the prior art, in efforts to seal between the bullets and casings of ammunition and to protect the exterior of the ammunition from the corrosive effects of moisture have been petroleum oils and/or waxes, which materials are so sticky that they tend to pick up, collect and carry dirt or foreign matter which is injurious to the firearms in which the ammunition is to be used and which tends to burn, carbonize and leave varnish-like residues when subjected to the temperature generated when the ammunition is used or fired and which foul the firearms.

As a result of the above, and to reduce the undesirable effects or results to be found in the use of such materials, such materials are applied to the ammunition as thin as is possible. In doing so the amount of dirt collected and the amount of residue that will be left is reduced, but also, the chances or odds that an effective seal will result is also reduced appreciably.

In many instances, where it is anticipated that ammunition is to be stored for long periods of time or is to be stored in humid clinates, a heavy protective coating is applied thereto, which coating must be removed by means of an appropriate solvent before the ammunition can be used. In such cases the ammunition is not ready for immediate use and requires the expenditure of considerable time, effort and material to make it ready for use.

At this time, I have no knowledge or information about any protective coating which is applied to ammunition by the prior art which does not readily collect and carry foreign matter and/or which does not burn and leave residue which foul the guns in which the ammunition is fired.

In the munitions art, it is common practice to provide rounds of ammunition of the general character here referred to which are such that when they are fired and the bullets travel through the air, they leave and are trailed by smoke and/or particles of burning material which can be visually observed. Such bullets are referred to as tracer bullets and are employed to aid or assist aiming and directing the fire or direction of other, conventional bullets from the firearm in which they are fired.

Conventional tracer bullets are wanting in many respects. Such bullets are hollowed out and filled with a combustible material which burns away as the bullets travel through the air and which leaves the desired trail. With such a structure, the weight of the bullet and its resulting trajectory and penetrating or impact characteristics are variable and totally different from a conventional bullet and the combustible material employed serves as an incendiary substance and is subject to igniting materials it comes into contact with, which materially restricts the use of such bullets.

An object of my invention is to provide a jacketed bullet of the character referred to which is such that the inner layer of its jacket vaporizes as the bullet travels through the air and is heated, whereby a visible vapor trail is left by the bullet to aid or assist in aiming the firearm from which the bullet is fired, for firing the next, succeeding round or rounds therefrom.

Further, I have no knowledge or information about a protective coating which is applied to ammunition by the prior art which can be applied in sufficient thickness to assure a seal about and between the bullets and casings, which has desirable lubricating characteristics and which leaves no undesirable residue in the firearms in which it is used or fired.

A object and feature of my invention is to provide improved hermetically sealed and lubricated ammunition of the character referred to.

Another object and feature of my invention is to provide ammunition of the character referred to in which excess moisture is exhausted from within the casing before the ammunition is sealed.

Still another object and feature of my invention is to provide ammunition with an improved coating or lubricous jacket having a hard, dry surface on or with which foreign matter will not stick or cling, a jacket the material of which lubricates the parts of a firearm in which it comes into contact with and which vaporizes when subjected to the temperatures generated when the ammunition is fired and so that it leaves no appreciable harmful or deleterious residue in the firearms.

Yet another object and feature of my invention is to provide a protective, sealing, lubricous jacket structure for ammunition characterized by an outer layer or skin of hard, dry, frangible material and a softer, viscous inner layer.

It is another object and feature of my invention to provide a novel method of producing ammunition and establishing a jacket of the character referred to above.

Finally, it is an object and feature of my invention to provide ammunition of the character referred to above wherein the protective, lubricous jacket is sufficiently tough and durable to withstand normal handling, is stable and long-lasting and is extremely easy and economical to establish or manufacture.

The foregoing and other objects and features of my invention will be fully understood from the following detailed description of typical preferred forms and application of my invention throughout which description reference is made to the accompanying drawing, in which.

Figure 1:
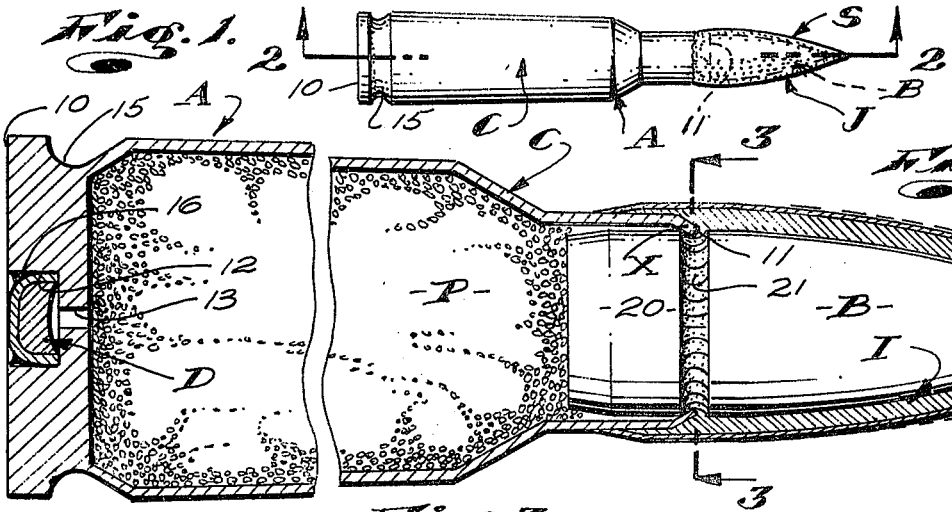
FIG. 1 is a side elevational view of an ammunition round established in accordance with and embodying my invention.

The ammunition round A, hereinafter called the "round", shown in FIGS. 1 through 3 of the drawings includes an elongate, tubular, cylindrical casing C with a closed rear end 10 and an open front end 11, a primer or detonator D in the rear end of the casing, a powder charge P within the casing, a bullet B engaged in the open front end of the casing and a lubricous, sealing jacket J about the bullet B and a portion of the casing.

The casing C is established of a resilient metal, preferably brass.

The front end 11 of the casing is characterized by a radially inwardly turned or crimped edge X.

The closed rear end 10 of the casing has a central longitudinally outwardly opening detonator receiving socket opening 12 and has a central opening 13 between and communicating with the bottom of the socket 12 and the interior of the casing.

In addition, the rear end portion of the casing C is provided with a radially outwardly opening annular extractor groove 15.

Figure 2:
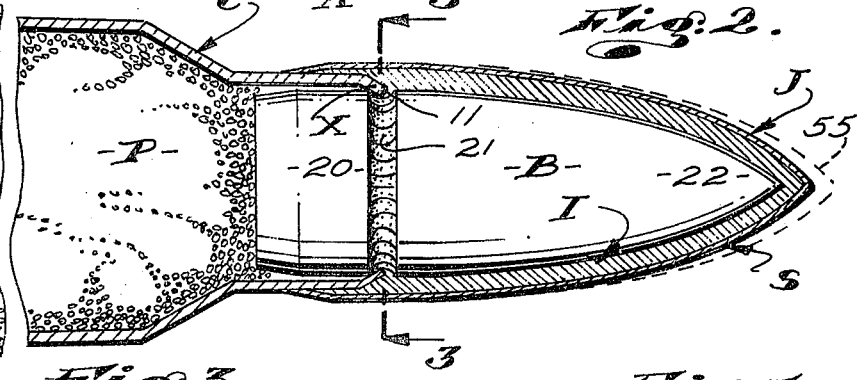
FIG. 2 is an enlarged detailed sectional view taken substantially as indicated by line 2—2 on FIG. 1.

The detonator D is a forwardly opening, cylindrical metal cup filled with a phospor primer material and is press-fitted in the socket 12, as shown in FIG. 2 of the drawings.

The detonator D is sealed in the socket by a body of sealing compound 16 deposited in the annular space between the sides of the cup and socket as illustrated. The compound is applied by wiping it across the rear end of the casing.

Figure 3:
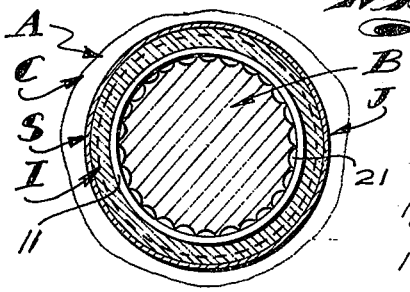
FIG. 3 is a view taken as indicated by line 3—3 on FIG. 2.

In the form of round A shown in FIGS. 1 through 3 of the drawings, the forward end portion of the casing is reduced and is smaller in diameter than the rear portion thereof.

Figure 4:
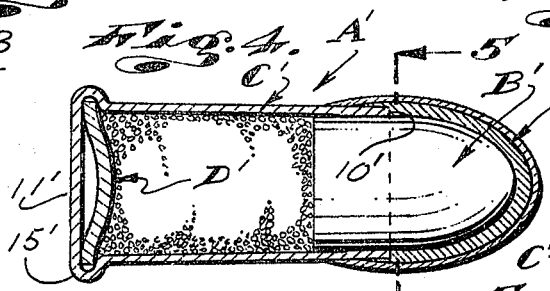
FIG. 4 is a sectional view of another form of ammunition round.
Figure 5:
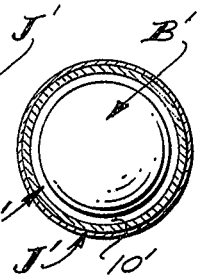
FIG. 5 is a view taken as indicated by line 5—5 on FIG. 4.

In FIGS. 4 and 5 of the drawings, another form of ammunition round A′ is illustrated. In this form of round, the casing C′ is straight, its rear end 11′ is imperforate and is formed to establish a radially outwardly projecting extractor bead 15'; the detonator D' is arranged within the casing with its edge at or with the bead 15', the bullet B' is press-fitted in the front end 10' of the casing C' and the jacket J', extends about the front portion of the casing and about the portion of the bullet projecting therefrom.

The last form of the round is typical of that form of class of ammunition called "Rim Fire" ammunition, while the first form or class of ammunition is commonly referred to as "center fire" ammunition.

Referring once again to the first form of ammunition, the bullet B is an elongate metal projectile or part with a cylindrical rear portion 20 slidably engaged in the front portion of the casing C and has a serrated, radially outwardly opening annular channel or groove 21 in which the crimped edge of the casing is entered to form and establish snug, mated engagement with the radially outermost parts or peeks of the serrated surface of the groove.

It is to be understood that the term "serrated" as above and hereinafter employed, has been selected and is used in a general and broad sense and is meant to include any surfacing which establishes spaced parts or portions which are engaged by the crimped edge of the casing and deformed thereby to establish a snug matted fit therebetween and/or between which portions of said edge of the casing engage to establish such a fit therebetween.

The bullet next and finally includes forwardly convergent, pointed front end portion 22.

The Powder P is a loose granular body of gun powder deposited in the casing.

The jacket J is a structure which occurs about the forward end portion of the casing and thence forwardly and about the portion of the bullet projecting forwardly from the casing. The jacket J is characterized by an inner layer I of plastic lubricous non-hygroscopic material and an outer layer or skin S of hard, dry, frangible material. The jacket J is bonded to the casing and the bullet to protect the adjacent surfaces thereof from the effects of the ambient atmosphere and extends across and seals the joint or connection between the bullet and the crimped edge at the forward end of the casing, to hermetically seal the interior of the casing.

The outer layer of skin S of the jacket is established of Carnuba Wax and is intimately bonded and mechanically locked onto and with the thin layer I. The inner layer I is established primarily hydrogenated vegetable oil, such as Safflower oil, which is hydrogenated to an extent that it is stiff, non-fluid and plastic in nature and includes a limited quantity of Carnuba Wax which wax serves to stiffen and/or reinforce the oil and mechanically connects and bonds the inner layer and outer skin together.

The inner layer I is such that it vaporizes at a temperature below its flash point or temperature of combustion and the Carnuba wax contained therein is sufficiently finely divided and disbursed in the layer I so that when the oil is vaporized, the wax is carried by the vapor.

The skin S is extremely thin and so brittle and frangible that upon impact and/or upon loss of support by the inner layer, when the inner layer is removed as by vaporization, it breaks down into finely divided particles which are readily carried to a substantial extent by the vaporous material of the inner layer, by the air and/or by the gases of combination of the powder P when the ammunition is fired in a related firearm, such as a rifle.

The oil of the layer I is hydrogenated so that its latent temperature of vaporization is, for example, from 600° F. to about 700° F.

In practice, the layer I is made up or contains about ¾ hydrogenated vegetable oil and ¼ Carnuba Wax.

The ammunition round A that I provide is exhausted of excess moisture ladened air and is hermetically sealed so that the powder P is free of excess moisture and is maintained dry.

The jacket J serves to effectively and efficiently lubricate the parts and surfaces of the firing chamber and the barrel of the firearm or rifle which it is urged into contact with when it is engaged therein or therewith for firing and when it is fired therein.

The temperature generated and/or encountered and the movement of gases in the firearm or rifle when the round A is fired are sufficient to liquefy and/or vaporize the oil and to vent and carry away the vaporous oil and the wax carried thereby.

It is to be noted that the latent temperature of vaporization of the Carnuba Wax is approximately 1,000° F., well above the temperatures which are encountered in the rifle, except in the direct presence of or contact with the burning powder. As a result of the above, the wax not contacted by the burning powder and instantly vaporized and/or burned cleanly thereby remains in the form of hard and dry finely divided particles.

In establishing my new ammunition round A, the round is preassembled in accordance with common and regularly practiced procedures for the production of ammunition rounds, except for establishing or application of the jacket J thereon. That is, the detonator D is engaged and sealed in the casing, the powder P is deposited therein, the bullet B is engaged in the casing and the casing is crimped into engagement with the bullet to establish what is and will be hereinafter referred to as a "preassembled unjacketed round".

Figure 6:
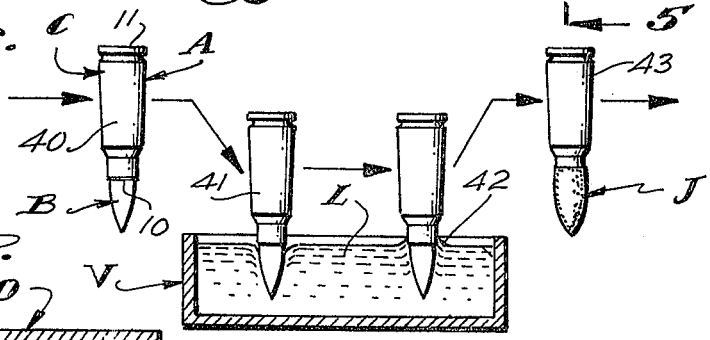
FIG. 6 is a diagrammatic view of the steps performed in one carrying out of my new process.

Following the above, the preassembled unjacketed round is dehydrated or excess moisture is drawn or evacuated therefrom, the round is hermetically sealed and the jacket J is established and/or applied thereon in accordance with the following novel method or process that I provide and diagrammatically illustrate in FIG. 6 of the drawings.

A liquid solution or mixture L of hydrogenated vegetable oil and Carnuba Wax is heated and melted in an opening vessel V. The preassembled unjacketed round A is arranged on a vertical axis above the level of the heated liquid solution L with its front end disposed downwardly, substantially as shown at 40 in FIG. 6 of the drawings.

The round is next lowered into the vessel to an extent that the forward portion of the bullet B projecting from the casing C is fully submerged in the heated liquid solution and to an extent that the front, lowermost, edge of the casing occurs at or below the surface of the heated solution as indicated at 41.

The round is suspended or left immersed in the heated solution a sufficient time to heat and expand the air and moisture in the casing and to cause it to vent between the bullet and the front end of the casing and thence into and thence out of said liquid solution.

The escape of the moisture ladened air can be visually detected by the presence of bubbles from the solution escaping from about the front end of the casing.

The round is also permitted to remain in the solution for a sufficient period of time to permit the solution to climb upwardly and about the forward portion of the casing, by capillary attraction and as indicated at 42.

The round A is next elevated and extracted from the solution, as shown at 43 and is permitted to cool. As the round A cools, the surface of the solution coating the round cools first. Since the Carnuba Wax has a higher melting point than the hydrogenated oil, the wax at the surface of the coating sets and hardens first and the wax within the coating adjacent the surface thereof coalesces with the wax at the surface to establish the hard, dry skin S of the jacket J and the mechanical bond between the skin and the layer I beneath it. Finally, the layer I solidifies.

As the jacket cools and sets, it effectively hermetically seals the casing and prevents the movement of air and moisture back into the casing.

When the jacket has set and the round has cooled sufficiently, it is finished and is appropriately packaged and stored for distribution and subsequent use.

In practice, the solution L contains about ¼ wax, ¾ oil and is heated to about 300° F. The round A is dipped for approximately 10 seconds and a jacket J, about 1 mill in thickness is established thereon.

By varying the period of time, the round is submerged in the solution L and the extent to which it is heated, the amount of moisture ladened air that is urged from the casing can be varied and the thickness of the jacket J can be varied.

The longer the period of dip is extended, the more heat is absorbed by the round and the more moisture ladened air is driven therefrom. At the same time, the hotter the round is let to become, the thinner the jacket will be about the front end of the casing and the rear portion of the bullet. Also, the thickness of the jacket at the front end of the bullet will be greater than the thickness of the jacket about the rear portion thereof and about the casing, due to the tendency of the coating to flow or slump slightly as the round is permitted to cool.

In FIG. 2 of the drawing, the dotted line 55 indicates the manner in which the front portion of the jacket can be made thicker than the rear portion thereof.

By varying the temperature of the solution and/or by varying the melting range of the hydrogenated oil, further control of the dip period and the resulting thickness of the jacket can be attained.

In practice, when the round is extracted from the solution and cooling begins, a small amount of the solution is or may be drawing up into the annulus between the bullet and casing to assure a proper desired seal.

It is important to note that the temperature maintained in carrying out the above process are well below the flash point of the primer and powder and is safe.

From the foregoing, it will be apparent that the process that I provide to establish my new jacketed, hermetically sealed, lubricating and vapor trailing ammunition round is extremely easy and simple and is such that it can be effectively carried out or performed by simple mechanical means.

In practice, and in addition to the process illustrated in FIG. 6 and described above, the round A can, as illustrated in FIG. 7 of the drawings, be heated in a suitable oven O, before dipping, to heat and drive excess moisture from the casing before dipping and to thereby reduce the dip period materially. In this modified carrying forward of my invention, the round can be heated to, for example, about 300° F. for a sufficiently long period of time to assure that all excess moisture is driven therefrom, following which it is dipped, sealed and its jacket J is established.

Figure 7:
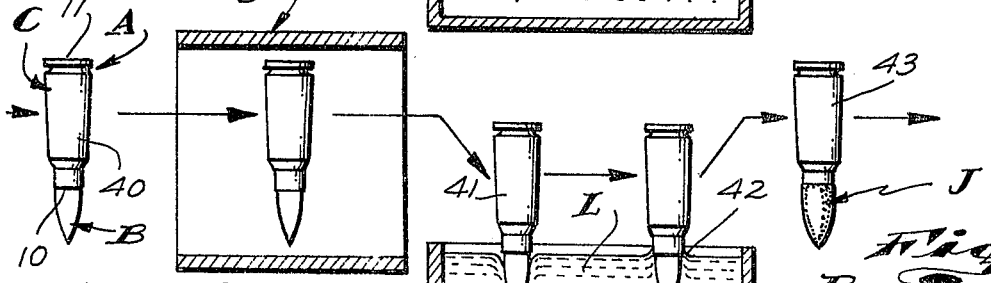
FIG. 7 is a diagrammatic view of the steps of another carrying out of my new process.

Still further, in carrying forward the process and in addition to the basic process illustrated in FIG. 6 and/or in addition to the process illustrated in FIG. 7, the round can be chilled following dipping to set the skin of the jacket more rapidly and thereby better control the thickness and disposition of the jacket material. Chilling of the round A, following dipping, also reduces the cooling time following dipping and speeds production.

Figure 8:
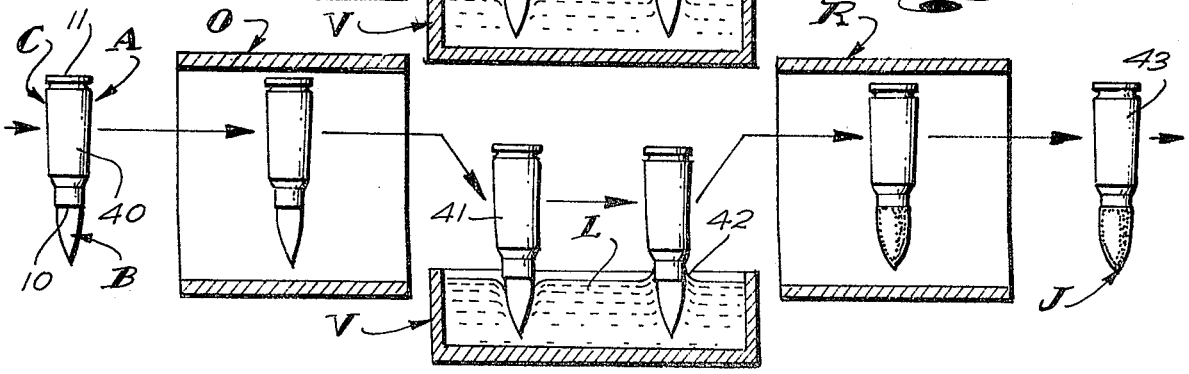
FIG. 8 is a diagrammatic view showing the steps of a third form of the process that I provide.

In FIG. 8 of the drawings, I have illustrated the process shown in FIG. 7 and in addition thereto have shown a suitable chilling chamber (refrigerated chamber) R and through which the round A is advanced after dipping.

While the latent temperature of vaporization of the carnuba wax is approximately 1,000° F. when mixed with and in the presence of the hydrogenated oil, the temperature of vaporization of which is 600° F. or 700° F., the carnuba wax will vaporize with and at near the same temperature of the oil. While it has not be determined exactly what temperatures the oil and wax vaporize, it has been determined that the oil and wax are substantially completely vaporized at about 750° F.

Having described only one typical preferred form and application of my invention, I do not wish to be limited or restricted to the specific details herein set forth, but wish to reserve to myself any modifications and/or variations that may appear to those skilled in the art to which this invention pertains.

Having described my invention, I claim:

1. The method of making an ammunition round comprising an elongate tubular metal casing with an open front end and a closed rear end, an elongate metallic bullet with a rear end engaged and held in the front end of the casing and a forward portion projecting forwardly from the casing and a lubricous protective jacket structure about the forward portion of the bullet and continuing rearwardly about the forward portion of the casing to seal about and between the bullet and casing, said jacket comprising an inner layer of soft, viscous plastic lubricous material and a thin outer skin of hard, dry, frangible material, said method comprising; first, assembling the casing, and bullet; second, heating a volume of a mixture of normally non-fluid, plastic, viscous, hydrogentated vegetable oil and a normally hard, dry, brittle carnuba wax to a liquid state; third, arranging the assembly with its longitudinal axis vertically disposed and the bullet disposed downwardly; fourth, lowering the assembly to submerge the bullet and the front end of the casing into the heated liquid mixture; fifth, elevating and extracting the assembly from the heated liquid mixture with a layer of said mixture deposited thereon; and sixth, permitting the heated assembly to cool whereby the wax at and adjacent to the surface of the deposit first cools and hardens and establishes the hard, dry, frangible skin of the jacket about the remainder of the deposit and said remainder of the deposit next solidifies to establish the inner layer of the jacket.

2. The method set forth in claim 1 wherein during said fourth step, the assembly is left to remain in the heated liquid mixture a sufficient time to heat and expand air and moisture in the casing, whereby excess moisture is urged from within the casing through the front end thereof and about the bullet.

3. The method set forth in claim 1 wherein during said fourth step, the assembly is left to remain in the heated liquid mixture a sufficient time to heat and expand air and moisture in the casing, whereby excess moisture is urged from within the casing through the front end thereof, about the bullet and whereby a portion of the deposit is subsequently drawn between the casing and the bullet to seal therebetween when the assembly cools and air in the casing contracts.

4. The method set forth in claim 1 which further includes heating the assembly before step four to heat and expand the moisture and air in the casing and cause excess moisture to escape from within the casing from the front end thereof and about the bullet.

5. The method set forth in claim 1 which further includes heating the assembly before step four to heat and expand the moisture and air in the casing and cause excess moisture to escape from within the casing from the front end thereof and about the bullet whereby a portion of the deposit to be drawn and to seal between the casing and the bullet when the assembly cools and air in the casing contracts.

6. The method set forth in claim 1 which further includes subjecting the assembly to a chilled atmosphere during step six to harden the skin quickly whereby the extent to which the deposit flows relative to the casing and bullet and resulting variations in thickness of the jacket is controlled.

7. The method set forth in claim 6 wherein during said fourth step, the assembly is left to remain in the heated liquid mixture a sufficient time to heat and expand air and moisture in the casing whereby air and excess moisture are urged from within the casing through the front end thereof, about the bullet.

8. The method set forth in claim 6 wherein during said fourth step, the assembly is left to remain in the heated liquid mixture a sufficient time to heat and expand air and moisture in the casing whereby air and excess moisture are urged from within the casing through the front end thereof, about the bullet, and whereby a portion of the deposit is drawn and seals between the casing and the bullet when the assembly cools and air in the casing contracts.

9. The method set forth in claim 6 which further includes heating the assembly before step four to heat the moisture and air in the casing and about the powder to cause excess moisture to escape from within the casing from the front end thereof and about the bullet.

10. The method set forth in claim 1 wherein the mixture contains about ¼ carnuba wax and ¾ hydrogenated vegetable oil.

11. The method set forth in claim 1 wherein the mixture contains about ¼ carnuba wax and ¾ hydrogenated vegetable oil, the oil being hydrogenated to an extent that its latent temperature of vaporization is about 600° F.

* * * * *